United States Patent [19]

Kretschmer

[11] 4,402,648

[45] Sep. 6, 1983

[54] CHOPPER PUMP

[75] Inventor: Stephen L. Kretschmer, Elk Grove Village, Ill.

[73] Assignee: A. O. Smith Harvestore Products, Inc., Arlington Heights, Ill.

[21] Appl. No.: 297,855

[22] Filed: Aug. 31, 1981

[51] Int. Cl.[3] ..... F04D 29/70

[52] U.S. Cl. ..... 415/121 B; 415/206; 415/196

[58] Field of Search ..... 415/121 B, 206, 196; 416/183, 185; 241/46 A, 46.02, 46.11, 46.17, 82.4, 82.5, 246

[56] References Cited

U.S. PATENT DOCUMENTS

| | | | |
|---|---|---|---|
| 2,665,853 | 1/1954 | Nicholson, Jr. | 241/298 |
| 3,417,929 | 12/1968 | Secrest | 241/46.04 |
| 3,432,107 | 3/1969 | Johnson | 241/46.17 |
| 3,563,291 | 2/1971 | Anderson | 241/82.5 |
| 3,738,581 | 6/1973 | Gallauresi et al. | 241/46.02 |
| 3,847,360 | 11/1974 | Seydelmann | 241/82.4 |
| 3,866,841 | 2/1975 | Iwahara | 241/46.11 |
| 3,948,450 | 4/1976 | Erlitz | 241/46 |
| 3,973,866 | 8/1976 | Vaughan | 415/121 |
| 4,036,442 | 7/1977 | Barnes | 241/82.5 |
| 4,141,510 | 2/1979 | Smith | 241/46 A |
| 4,347,035 | 8/1982 | Stahle | 241/46.17 |

FOREIGN PATENT DOCUMENTS

| | | | |
|---|---|---|---|
| 2813617 | 10/1978 | Fed. Rep. of Germany | 415/121 B |
| 2035455 | 6/1980 | United Kingdom | 415/206 |

*Primary Examiner*—Harvey C. Hornsby
*Assistant Examiner*—Thomas W. Epting
*Attorney, Agent, or Firm*—Andrus, Sceales, Starke & Sawall

[57] ABSTRACT

A chopper pump for pumping and chopping a slurry which contains fibrous material. The pump includes a housing having a bottom inlet and a tangential outlet. A single vane impeller is mounted for rotation within the housing and a generally square cutter blade is mounted on the vane and rotates in proximity with fixed cutter teeth on the housing to thereby comminute solid materials. Extending downwardly from the vane of the impeller through the inlet opening is a generally curved fin or blade that is concentric with the axis of rotation of the impeller and has a sharpened leading diagonal edge adapted to cut stringy fibrous material.

7 Claims, 5 Drawing Figures

CHOPPER PUMP

BACKGROUND OF THE INVENTION

Liquid manure systems are commonly used in livestock operations. In the conventional liquid manure system, the manure is flushed from the barn or feeding area and delivered to a below-ground pit, and the manure slurry is subsequently pumped from the pit into a mobile tank for spreading on the fields. Before pumping the slurry from the pit, the slurry is agitated in order to break up the solid materials and provide a more homogeneous mass.

In the conventional liquid manure system, a chopper pump is used to agitate and chop the fibrous materials in the slurry and subsequently to pump the slurry from the pit. The conventional chopper pump includes a pump housing having a bottom inlet and a tangential outlet and the outlet of the pump is connnected to an adjustable nozzle which can be moved to agitate the slurry. After agitation, the outlet of the pump is connected to a delivery pipe to pump the slurry to a discharge site or mobile tank.

In the typical chopper pump, a chopper blade is formed integrally with the impeller and rotates in close proximity to a series of fixed chopper teeth carried by a chopper plate bordering the inlet opening to thereby chop or comminute the particulate material in the manure slurry. After a period of use, the chopper blade will wear, and in the past, due to the integral construction, it has been necessary to replace the entire impeller in order to obtain a new chopper blade.

As the manure slurry contains fibrous or stringy materials, as well as solid materials, there is a tendency for the fibrous material to wind up on the rotating impeller and clog the pump. In an attempt to prevent this problem, slingers or blades have been attached to an extension of the impeller shaft and have been located below the inlet to the pump. Rotation of the blade or slinger acts to cut the stringy fibrous material, but it has been found that the stringy material will nevertheless, tend to wind around the shaft of the blade to thereby restrict the intake opening to the pump and ultimately cause clogging of the pump.

SUMMARY OF THE INVENTION

The invention is directed to an improved chopper pump for pumping and chopping a slurry, such as a manure slurry, which contains stringy or fibrous materials, In accordance with the invention, the pump comprises a housing having a bottom inlet opening and a tangential outlet. A single vane impeller is disposed within the housing and the lower edge of the vane carries a generally square chopper blade that rotates in close proximity with a plurality of fixed chopper teeth on the housing to thereby chop or comminute the solid, particulate material.

Extending downwardly from the impeller vane through the inlet opening is a generally curved fin or cutting blade that is a portion of a cylinder and is located concentric of the axis of rotation of the impeller. The cutting blade or fin is provided with a sharpened diagonal edge that leads in the direction of rotation and is adapted to cut stringy materials.

As the fin is attached to the impeller vane and has a sharpened leading edge, it will cut or slice stringy material and yet the stringy material cannot wind around the fin, thereby preventing the tendency of stringly material to wind up and clog the impeller.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
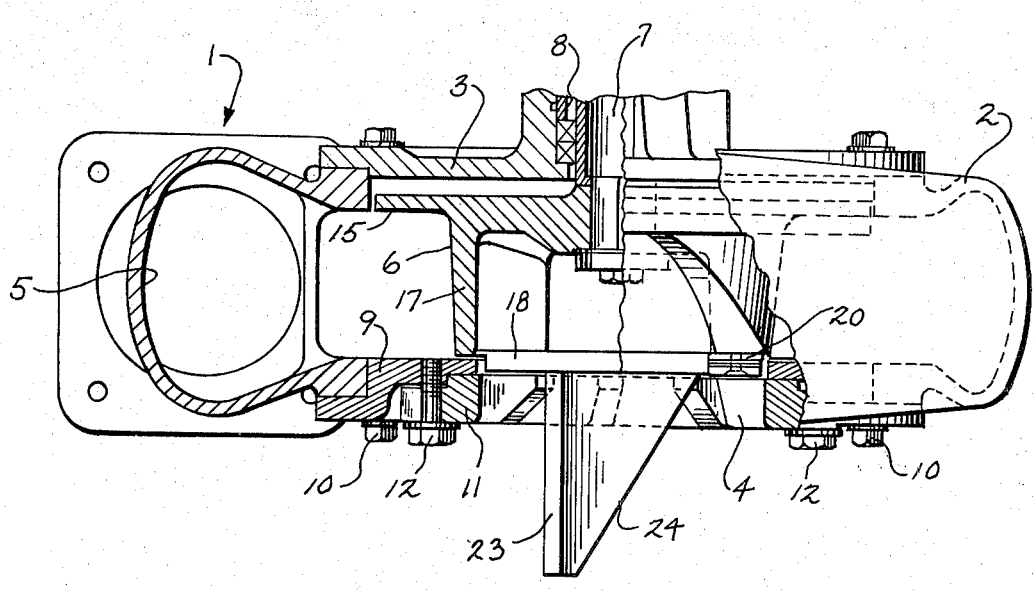
FIG. 1 is a side elevation of the chopper pump of the invention with parts broken away in section.
Figure 2:
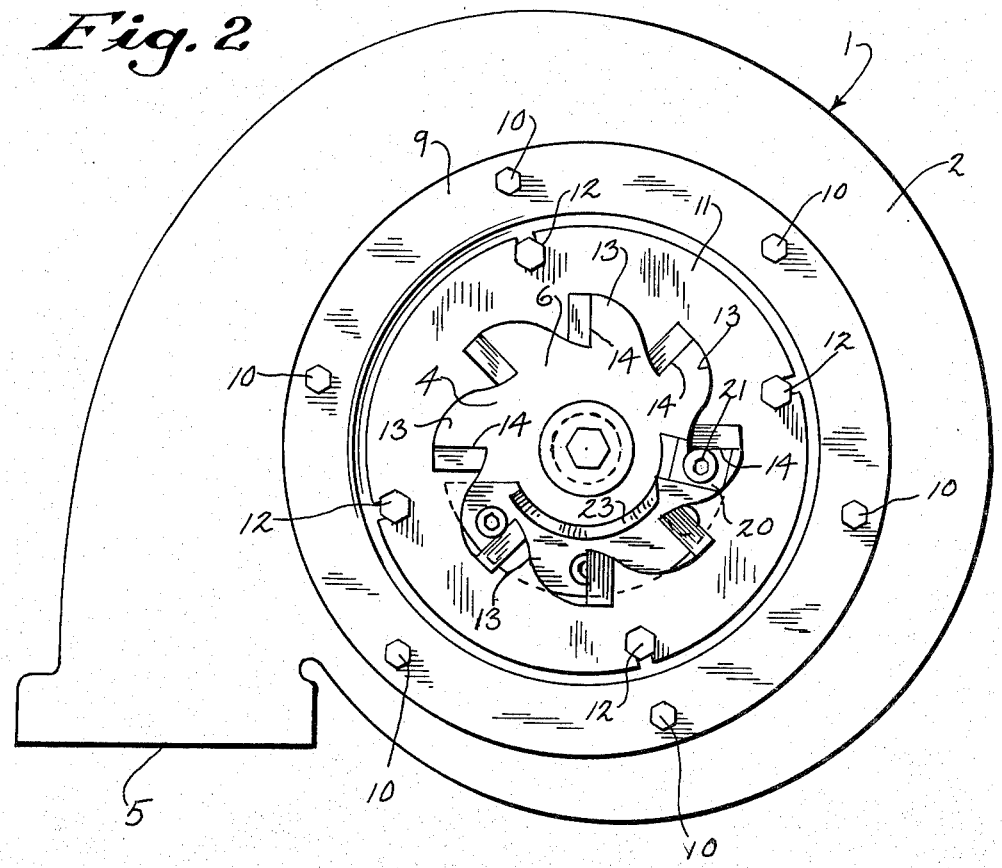
FIG. 2 is a bottom view of the pump of FIG. 1.
Figure 3:
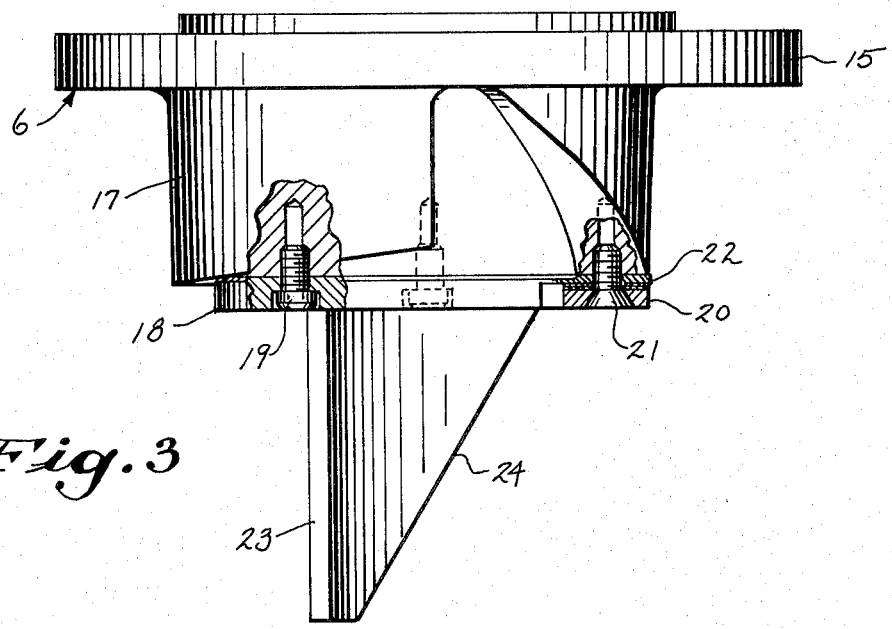
FIG. 3 is a side elevation of the impeller with parts broken away.

FIGS. 1 and 2 show a chopper pump 1, having particular use in a liquid manure system, for chopping and pumping a slurry containing solid and fibrous material. The pump 1 includes a volute-shaped housing 1 and the upper end of the housing is provided with an opening which is enclosed by a hub member 3.

The slurry is drawn into the housing through a bottom inlet 4 and is discharged through the tangential outlet 5 by impeller 6.

As shown in FIG. 1, the impeller 6 is mounted on the lower end of a rotatable drive shaft 7 which is sealed within an opening in hub member 3 by a conventional packing 8.

Bordering the inlet opening 4 is an annular intake plate 9 which is bolted to the housing through a series of bolts 10. A chopper plate 11 is attached to intake plate 9 through bolts 12, and the inner diameter of the chopper plate 11 is provided with a series of scallop-shaped recesses 13 which terminate in a plurality of hardened chopper teeth 14.

Figure 4:
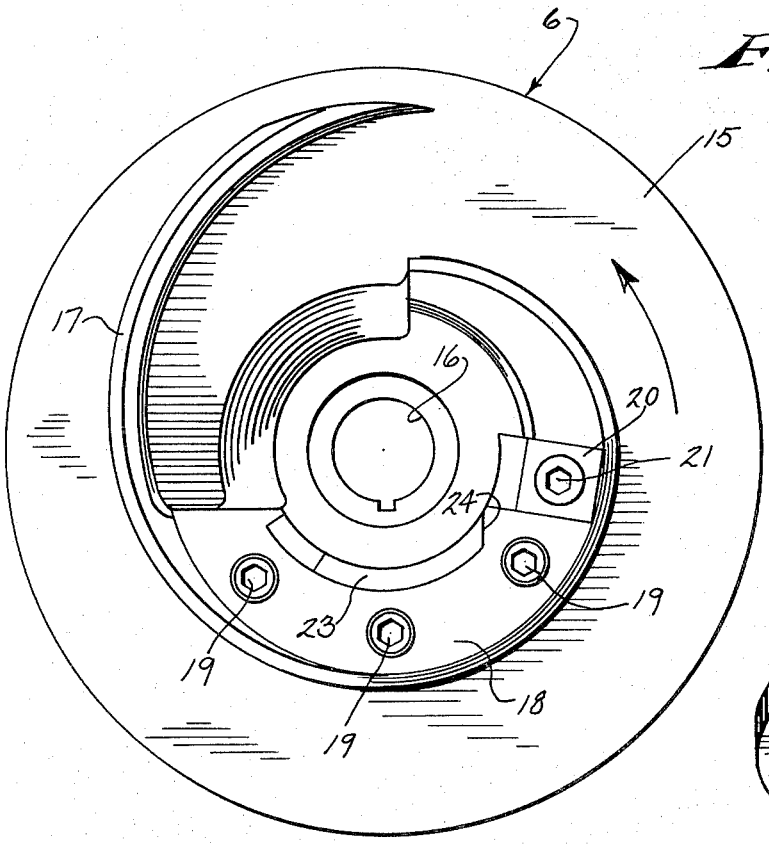
FIG. 4 is a bottom view of the impeller.
Figure 5:
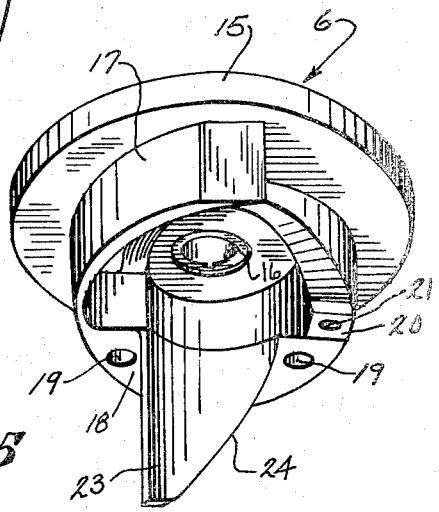
FIG. 5 is a perspective view of the impeller.

The impeller 6 includes a base 15 having an opening 16 within which the shaft 7 is keyed. A single involute vane or blade 17 projects downwardly from the base 15, and as shown in FIG. 4, the vane extends through an arc of approximately 360°.

A generally curved plate 18 is mounted on the lower edge of the vane 17 through bolts 19, and a generally square chopper blade 20 is attached to the leading edge of plate 18 in the direction of rotation, by bolts 21. The chopper blade 20 is provided with four sharpened edges, and the edge which is leading in the direction of rotation is adapted to rotate in close proximity to the hardened teeth 14 on chopper plate 11, to thereby cut or comminute the solid and particulate material in the slurry.

In order to properly adjust the position of the chopper blade 20 with respect to the teeth 14, one or more shims 22 can be positioned between the cutter blade and the base 15.

When the leading edge of the chopper blade 20 is worn, the bolt 21 can be loosened and the blade can be indexed 90° to present a new cutting edge to the teeth 14. This is a distinct advantage over conventional chopper pumps in which the chopper blade was formed integrally with the impeller, thereby requiring that the entire impeller be replaced when the chopper blade was worn.

In accordance with the invention, a generally curved cutting blade or fin 23 is mounted on the plate 18 and extends downwardly through the inlet opening 4, as best illustrated in FIG. 1. The fin 23 is provided with a sharpened diagonal edge 24 which leads in the direction of rotation. As best shown in FIG. 4, the fin 23 extends through an arc of approximately 90° and is a portion of a cylinder, being concentric with the axis of rotation of the shaft 7.

As the impeller is rotated, the sharpened diagonal edge 24 of the fin will slice or cut fibrous or stringy material and due to the diagonal edge and the offset concentric disposition of the fin, there will be no tendency for the stringy material to wind up on the fin or on the impeller.

While the drawings have shown the impeller having a single vane and a single fin, it is contemplated that in certain situations depending upon the size of the pump and the inlet opening, a plurality of vanes and fins can be incorporated. However, when the inlet opening is relatively small, a single vane and fin is preferred in order that the inlet is not unduly obstructed.

Various modes of carrying out the invention are contemplated as being within the scope of the following claims particularly pointing out and distinctly claiming the subject matter which is regarded as the invention.

I claim:

1. A chopper pump for chopping and pumping a slurry containing particulate and fibrous materials, comprising a housing defining a pumping chamber and having an axial inlet opening and a tangential outlet opening, a rotatable impeller mounted within the pumping chamber and having a vane extending toward said inlet, said vane being disposed in a helical relationship to the axis of rotation of the impeller, a fin carried by the impeller and extending outwardly through said inlet opening, with the outer portion of said fin being disposed on the exterior of said housing, said fin having a diagonal cutting edge swept back in the direction of rotation of the impeller, said fin being a portion of a cylinder and disposed concentrically with said axis of rotation, said fin disposed to cut fibrous material in the slurry.

2. The pump of claim 1, wherein said diagonal edge is sharpened.

3. The pump of claim 1, wherein said impeller includes a single vane.

4. The pump of claim 3, wherein said vane extends through approximately 360° and said fin extends through an arc of approximately 90°.

5. A chopper pump for chopping and pumping a slurry containing particulate and fibrous materials, comprising a housing defining a pumping chamber and having an axial inlet opening and a tangential outlet opening, an annular chopper plate bordering the inlet opening and having a plurality of circumferentially spaced chopper teeth, a rotatable impeller disposed within the pumping chamber and having an involute-shaped vane facing toward said inlet opening, a generally polygonal chopper blade having a plurality of cutting edges and removably mounted on the outer edge of the vane and disposed to rotate in proximate relation to said chopper teeth, whereby the blade and the teeth cooperate on rotation of the impeller to chop particulate material, means for mounting the blade for indexing movement relative to the vane to selectively position the respective cutting edges in chopping relationship with said teeth, and a cutting fin having a base secured to the outer edge of the vane and having an outer end projecting outwardly through the inlet opening to an unconfined position on the exterior of said housing, said fin being a portion of a cylinder and disposed concentrically with respect to the axis of rotation of the impeller, said fin having a diagonally extending edge leading in the direction of rotation and being swept back in the direction of rotation from said base to said outer end, said diagonal edge disposed to cut fibrous material.

6. The pump of claim 5, wherein the chopper blade is located adjacent the fin and forwardly of the fin in the direction of rotation of the impeller.

7. The pump of claim 5, and including a mounting member secured to the outer edge of the vane, said chopper blade being removably mounted to the forward end of the mounting member in the direction of rotation of the impeller, and said fin being attached to said mounting member and located to the rear in the direction of rotation from said chopper blade.

* * * * *